United States Patent [19]

Eckert et al.

[11] 4,161,935

[45] Jul. 24, 1979

[54] FUEL INJECTION SYSTEM FOR AN INTERNAL COMBUSTION ENGINE

[75] Inventors: Konrad Eckert; Siegfried Holzbaur, both of Stuttgart; Wolf Wessel, Oberriexingen; Hermann Grieshaber, Stuttgart, all of Fed. Rep. of Germany

[73] Assignee: Robert Bosch GmbH, Stuttgart, Fed. Rep. of Germany

[21] Appl. No.: 836,104

[22] Filed: Sep. 23, 1977

[30] Foreign Application Priority Data

Oct. 7, 1976 [DE] Fed. Rep. of Germany ..... 2645215

[51] Int. Cl.[2] ..... F02M 9/08

[52] U.S. Cl. ..... 123/139 AW; 261/50 A; 261/44 D

[58] Field of Search ..... 123/139 AW; 261/50 A, 261/44 D, 88; 137/330, 331, 332, 100; 251/205

[56] References Cited

U.S. PATENT DOCUMENTS 3,920,778 11/1975 De Rugeris ..... 261/50 A X

*Primary Examiner*—Alan Cohan

*Attorney, Agent, or Firm*—Edwin E. Greigg

[57] ABSTRACT

A continuous fuel injection system for metering out fuel to the induction tube of an internal combustion engine. An air flow metering assembly in the induction tube includes a baffle plate which is set with its plane perpendicular to the air flow vector and is mounted on a shaft which slides axially in bearings. As a result of the air flow, the baffle plate is displaced axially to varying extent and this displacement is opposed by a restoring force provided by pressurized fuel and subject to adjustment on the basis of engine variables. A vaned impeller wheel, mounted on the baffle shaft, causes rotation of the shaft in the bearings, thereby eliminating static friction and preventing hysteresis effects. The centrifugal forces generated by the rotation aid in distributing the fuel and in admixing it with the incoming air.

19 Claims, 2 Drawing Figures

FUEL INJECTION SYSTEM FOR AN INTERNAL COMBUSTION ENGINE

BACKGROUND OF THE INVENTION

The invention relates to a fuel injection system for mixture-compressing and externally ignited internal combustion engines. The fuel injection system meters out a quantity of fuel in proportion to the aspirated combustion air and at the same time serves to insure uniform distribution and adequate preparation of the metered out fuel within the aspirated air. More particularly, the invention relates to a fuel injection system which employs continuous injection of fuel into the induction tube and in which the induction tube contains an air flow rate meter and, located behind it, an arbitrarily actuated throttle plate. The air flow rate meter has an axially movable member which is subject to a restoring force and displaces the movable part of a fuel metering valve. In a known fuel injection system of this general type, a sensor pin associated with the fuel metering valve outside of the induction tube senses the position of the air flow rate measuring member and provides no further preparation of the fuel which is simply delivered to the injection valves and introduced into the engine just ahead of the intake valves. This type of system results in substantial constructional expenditure and the relatively poor preparation of the fuel-air mixture causes the exhaust gases to contain undesirably high components of toxic materials and also results in a reduction of the engine power due to the uncombusted fuel.

OBJECT AND SUMMARY OF THE INVENTION

It is thus a principal object of the invention to provide a fuel injection system which is relatively compact and does not take up as much space as previously required. At the same time, the object of the invention is to increase the relative power of the engine while providing diminished consumption of fuel with respect to systems in the prior art. It is a further object of the invention to provide a fuel injection system in which exhaust gases are cleaner due to an improved preparation of the fuel-air mixture. These and other objects are attained, according to the invention, by providing a fuel injection system of the general type described above in which the air flow rate meter is a static plate or baffle plate located within the induction tube of the engine. The invention further provides that the fuel metering valve is contained in the central, axial portion of the baffle plate. The invention further provides that the metered out fuel is injected into the induction tube in the vicinity of the periphery of the baffle plate where the air stream velocity is highest. Yet another feature of the invention is to provide a rotating member which insures improved admixture of fuel and air.

In a particular feature of the invention, the rotating member is an impeller mounted on the bearing shaft of the baffle plate which rotates the baffle plate shaft and prevents sticking of the baffle plate on its shaft by overcoming any static friction and thus prevents a hysteresis characteristic of the motion of the baffle plate on its shaft. A particular advantage of the invention is that the fuel lines from the fuel metering valve to the point at which fuel is injected are very short. Yet another advantage is that a very thin film of fuel is produced on the fuel carrying surfaces due to to fuel being accelerated outwardly from the shaft by centrifugal forces.

In a preferred feature of the invention, the fuel metering valve has a triangular control opening which cooperates with a control slot that is parallel to one of the sides of the triangle, thereby producing an improved resolution of the displacement of the baffle plate and permitting an improved precision of adaptation of the metered out fuel to the requirements of the engine.

A further favorable feature of the invention is the provision of two mutually rotatable perforated rings as throttle members for improved preparation of the fuel-air mixture. When the restoring force on the baffle plate is generated by pressurized fluid, the adaptation of the fuel-air mixture to the requirements of the engine is made especially precise and simple.

The invention will be better understood as well as further objects and advantages thereof become more apparent from the ensuing detailed description of two preferred embodiments of the invention taken in conjunction with the drawing.

DESCRIPTION OF THE PREFERRED EMBODIMENTS

Figure 1:
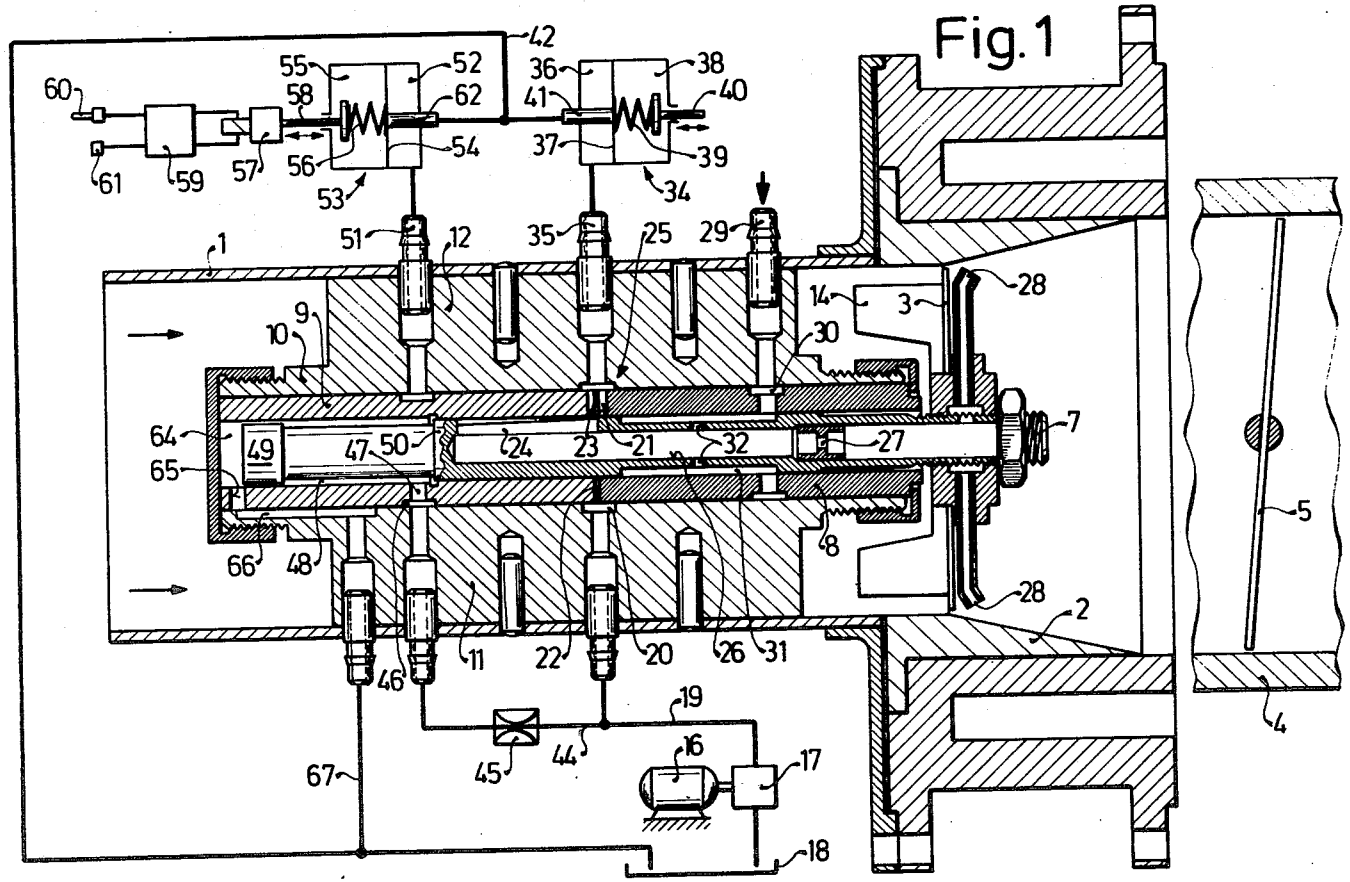
FIG. 1 is a sectional diagram through a first exemplary embodiment of the invention.

Turning now to FIG. 1, there is shown a fuel injection system including an induction tube region 1 into which air enters via an air filter, not shown, into a conical induction tube region 2 which contains an air flow rate meter embodied as a baffle plate 3. The air then continues through an induction tube region 4 containing an arbitrarily settable throttle plate 5 and continues to one or several cylinders, not shown, of an internal combustion engine. The baffle plate 3 is embodied as a circular plate whose plane lies perpendicular to the general direction of the air flow and which is displaced within the conical region 2 of the induction tube as an approximately linear function of the air flow rate through the induction tube. If the return force engaging the air flow rate meter is constant and if the air pressure ahead of the air flow rate meter is also constant, then the pressure between the air flow rate meter and the throttle valve 5 remains constant as well. The baffle plate 3 is coupled to a bearing shaft 7 which may be displaced axially within the induction tube in bearings 8,9. The bearings 8,9 are disposed within a hub 10 which is maintained in the center of the induction tube region 1 by means of bridges 11, 12. Attached to the baffle plate 3 is an impeller wheel 14 which is rotated by the air flow in the induction tube and thereby rotates the bearing shaft 7. The rotation of the bearing shaft 7 overcomes the static friction between the shaft and the bearings and thus prevents any hysteresis between the displacement of the baffle plate and the magnitude of the air flow rate which might otherwise occur due to static friction.

As illustrated in the figure, the axial displacement of the baffle plate serves for the direct actuation of a fuel metering valve. The overall fuel supply is insured, for example, by a fuel pump 17 driven by an electric motor 16 and arranged to pump fuel from a fuel container 18 through a fuel supply line 19 to an annular groove 20 in the aforementioned hub 10. The annular groove 20 communicates through radial openings 21 with a control slot 22 which is formed between the two bearings 8 and 9 and whose size is preferably defined by a spacer ring 23. When the bearing shaft 7 is displaced, the control slot 22 overlaps to varying degrees a control orifice 24 within the bearing shaft which is preferably embodied in the shape of a triangle one of whose sides is perpendicular to the axis of the bearing shaft. The control slot 22 and the control orifice 24 together constitute a fuel metering valve 25 located substantially within the extent of the bearing shaft. Fuel metered out by the fuel metering valve 25 flows downstream of the control orifice through an internal bore 26 and a throttle 27 located in the bearing shaft to injection positions which are disposed in the vicinity of the periphery of the baffle plate 3 where the velocity of the air flow is expected to be highest. The injection may take place via individual fuel openings 28 which communicate with the bearing shaft of the baffle plate 3 and which share in its rotation so that the metered out fuel is highly atomized and intimately mixed with the aspirated air. Alternatively, the metered out fuel may be prepared by supplying air through an air line 29, an annular groove 30 in the bearing 8, an annular groove 31 in the shaft 7 and openings 32.

The pressure of the fuel in the line 19 may be set and adjusted by a pressure control valve 34. The pressure control valve 34 includes a diaphragm 37 which defines a first chamber 36 and a second chamber 38. The first chamber 36 is connected by a line 35 to the annular groove 20 and the second chamber 38 contains a compression spring 39 whose effective force may be changed in dependence on operational variables of the engine. This may be done, for example, by an electromagnet, not shown, which engages the spring 39 via an actuating pin 40. Alternatively, an additional force which depends on operational engine variables may act directly on the diaphragm 37 in parallel with the spring 39. The pressure control valve 34 is embodied as a flat seat valve whose movable valve member is the diaphragm 37 which cooperates with a fixed valve seat 41 over which fuel may return to the fuel container 18 via a return line 42. The pressure control valve 34 defines the fuel system pressure. The restoring force acting on the baffle plate 3 in opposition to the force of the flowing air is provided by pressurized fluid. The pressurized fluid comes from a control pressure line 44 which branches off from the main fuel supply line 19 and contains a decoupling throttle 45. It terminates in an annular groove 46 within the bearing 9 which, in turn, communicates through a bore 47 with a pressure chamber defined by an annular groove 48 on the shaft 7. The side of the annular groove 48 remote from the baffle plate is defined by a shoulder 49 in the shaft having a larger diameter than the opposite shoulder 50 of the bearing shaft which defines the opposite limiting surface of the annular groove 48. In this manner, the pressurized fluid exerts a force on the bearing shaft 7 which acts in opposition to the direction of the air flow. In order to adapt the fuel-air ratio to the various changing operational requirements of the engine it may be suitable to alter the magnitude of the restoring force as a function of operational engine variables. In order to perform this variation, the annular groove 46 communicates via a line 51 with a chamber 52 in a pressure control valve 53. The chamber 52 is closed by a diaphragm 54 which defines a second chamber 55. A spring 56 urges the diaphragm 54 to close the valve 53; it is located in the chamber 55 and its force can be changed in dependence on operational engine variables. This change may be performed, for example, by an electromagnet 57 which engages the spring 56 via an actuating pin 58 or an additional and engine-dependent force may be provided in parallel with the spring 56 to act directly on the diaphragm 54. The electromagnet 57 may be controlled, for example, by an electronic controller 59 which receives a signal from an oxygen sensor 60 which measures the partial pressure of oxygen in the exhaust system of the engine and/or from a temperature sensor 61. The force exerted on the diaphragm 54 could also be provided by a bimetallic spring in dependence on the operational temperature of the engine. The pressure control valve 53 is embodied as a flat seat valve in which the diaphragm 54 is the movable valve member which cooperates with a fixed valve seat 62 over which fuel may flow back into the fuel container 18 via the aforementioned return line 42.

Any fuel which leaks over the shoulder 49 of the shaft 7 is collected in a collection chamber 64 and flows through an opening 65, a groove 66 and a leakage line 67 back to the return line 42.

The fuel injection system described above with respect to the illustration of FIG. 1 operates as follows:

When the internal combustion engine is operating, the fuel pump 17 driven by the electric motor 16 pumps fuel from the container 18 and delivers it through the fuel supply line 19 to the fuel metering valve assembly 25. At the same time, the engine aspirates air through the induction tube and the flowing air causes a certain displacement of the baffle plate from its normal position in opposition to the restoring force exerted by the pressurized fluid. Depending on the degree of displacement of the baffle plate 3, the triangular control orifice 24 in the bearing shaft 7 is displaced in the direction of the air flow, thereby exposing an increasing cross section of the control slot 22. As a consequence, the fuel quantity metered out by the valve 25 remains proportional to the air flow rate. The fuel pressure upstream of the valve assembly 25 as well as in the control pressure line 44 are maintained constant by the separate and previously described pressure control valves 34,53 but the fuel-air ratio may be adapted to different operational states of the engine by changing the value of the pressure defined by the pressure control valves 34, 53. The fuel metered out by the fuel metering valve assembly 25 is delivered via an internal bore 26 to the injection nozzles 28 which are disposed in the vicinity of the periphery of the baffle plate 3 where the air flow velocity is greatest and share in the rotation of the shaft caused by the impeller wheel 14. This rotation of the fuel nozzles produces a particularly advantageous preparation of the fuel-air mixture.

Figure 2:
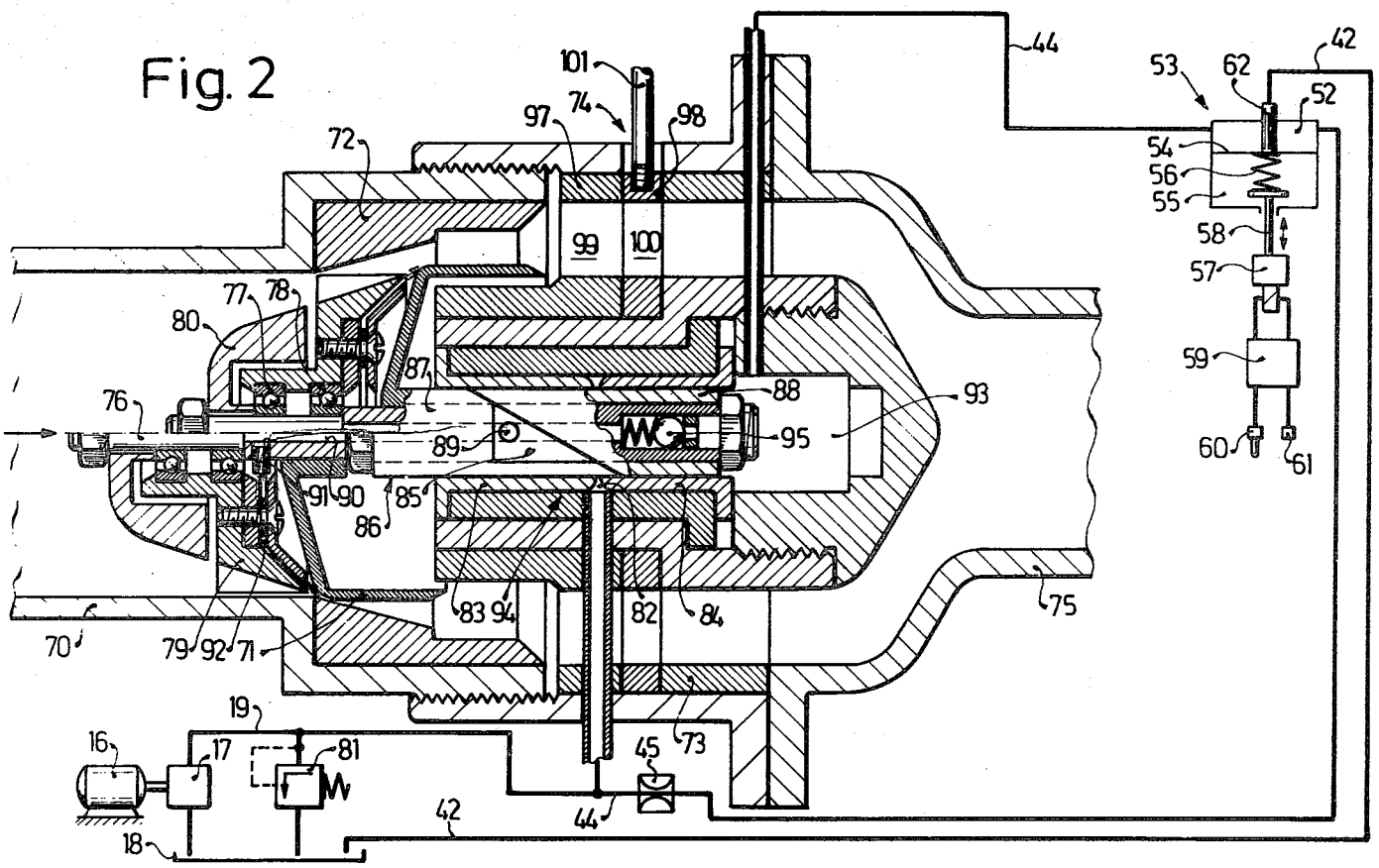
FIG. 2 is a sectional drawing through a portion of a second exemplary embodiment of the fuel injection system according to the invention.

A second embodiment of the invention is illustrated in FIG. 2 in which the air aspirated by the engine flows in the direction of the arrow through an induction tube region 70 containing a baffle plate 71 within a conical portion 72 of the induction tube. The air then continues through an induction region 73 containing an arbitrarily settable throttle valve 74 into an induction tube region 75 and then continues to one of several cylinders, not shown, of an internal combustion engine. As was the case in the first exemplary embodiment according to FIG. 1, the baffle plate 71 is axially displaceable on a shaft 76 within the induction tube. Upstream of the baffle plate 71, an impeller wheel 79 is mounted on the shaft 76 by ball bearings 77, 78. An air flow guiding cone 80 is located on the shaft 76 upstream of the impeller wheel 79.

As was the case in the embodiment of FIG. 1, fuel is supplied via line 19 and the fuel system pressure is defined by a pressure limiting valve 81. The fuel line 19 terminates in a control slot 82 defined between bearing bushings 83 and 84 which cooperate with the triangular control orifice 85 to form the fuel metering valve assembly 94. By contrast to the first exemplary embodiment according to FIG. 1, the control orifice 85 is not machined into the bearing shaft but is disposed in a bushing 86 which surrounds the bearing shaft. In particular the bushing 86 may be composed of two partial bushings 87, 88 having oblique edges, whereby the triangular control orifice 85 starts at the oblique edge and extends into the partial bushing 87. The relative overlap of the control slot 82 and the control orifice 85 permits a defined amount of fuel to pass through the valve and this fuel is conducted through a radial bore 89 into an axial bore 90 of the shaft and is injected via a tip 91 into an annular radial gap 92 within the impeller wheel 79. The centrifugal forces due to the rotation of the vaned impeller wheel 79 cause the fuel in the annular gap 92 to be flung outwardly and to be expelled as a finely distributed film near the periphery of the baffle plate 71 and in the region of the greatest air flow velocity. The lower part of FIG. 2 illustrates the position of the baffle plate and of the impeller wheel in a condition of low engine load while the upper portion of the illustration shows the same parts at full load.

The restoring force on the baffle plate is provided by fuel which comes from the control pressure line 44 and flows into a pressure chamber 93 into which the end face of the shaft 76 extends. The pressure of fuel in the control pressure line 44 may be adjusted by a pressure control valve 53 as was done in FIG. 1. Located in the shaft 76 between the pressure chamber 93 and the axial bore 90 and downstream of the fuel metering assembly 94 is a check valve 95 which opens during sudden opening motions of the baffle plate and permits flow to the axial bore 90 so that fuel may flow from the pressure chamber 93 into the axial bore 90 for a short time and can be expelled through the annular gap 92 in the propeller wheel 79 thereby producing a fuel enrichment effect during engine accelerations.

A further improvement of fuel preparation may attained by forming the throttle 74 with two mutually rotatable, perforated rings 97 and 98. The fixed perforated ring 97 then takes the place of the bridges 11 and 12 of FIG. 1 and will preferably be provided with circular openings 99 which cooperate with other, preferably circular, openings 100 in the movable perforated ring 98. The mutual overlap of the circular openings 99 and 100 defines the available flow cross section for the fuel air mixture. The perforated ring 98 may be rotated with respect to the stationary ring 97 by a pin 101 which is engaged in known manner by linkage from the accelerator pedal of the vehicle. The additional diminution of the effective flow cross section by the overlapping openings 99, 100 results in a further intensive admixture of the metered out fuel and the aspirated air and thus results in additional improvement of the quality of the mixture.

The foregoing relates to preferred exemplary embodiments of the invention, it being understood that other embodiments and variants thereof are possible within the spirit and scope of the invention.

What is claimed and desired to be secured by Letters Patent of the United States is:

1. In a fuel injection system for an internal combustion engine, said system including an air flow rate measuring member located in the induction tube of said engine, and seriatim thereto an arbitrarily settable throttle valve, said air flow rate measuring member being disposed for axial displacement with respect to said induction tube under the influence of said air flow, and there being provided means to exert a restoring force on said member in opposition to said air flow, and wherein said system further includes fuel metering means including a movable valve member, said movable valve member being moved by said displacements of said air flow rate measuring member, the improvement comprising:

said air flow rate measuring member is a baffle plate disposed on a shaft, and said fuel metering means is provided by features of said shaft and further comprising a rotating member disposed to rotate about the axis of said shaft, and means responsive to the air flow for rotating the shaft about its axis, and yet further comprising conduit means for delivering metered fuel from said fuel metering means to the vicinity of the periphery of said baffle plate where the air flow velocity is near maximum.

2. A fuel injection system as defined by claim 1, wherein said rotating member is a vane wheel.

3. A fuel injection system as defined by claim 2, wherein said vane wheel has its vanes set so as to be rotated by the air flowing through the induction tube.

4. A fuel injection system as defined by claim 3, wherein said vane wheel is fixedly mounted on said shaft of said baffle plate.

5. A fuel injection system as defined by claim 4, wherein said vane wheel has a radial annular gap which communicates with said fuel metering means and serves to deliver fuel to the periphery of said vane wheel.

6. A fuel injection system as defined by claim 4, wherein said vane wheel is fixedly attached to said baffle plate.

7. A fuel injection system as defined by claim 6, wherein said baffle plate has internal conduits terminating at its periphery, said internal conduits communicating with said fuel metering means to thereby deliver fuel to the periphery of said baffle plate.

8. A fuel injection system as defined by claim 1, wherein said fuel metering means is provided by said shaft having an internal bore and there being provided in the wall of said shaft a control orifice of generally triangular shape which cooperates with a control slot provided in stationary features of said induction tube to form a metering opening of variable size depending on the axial position of said shaft.

9. A fuel injection system as defined by claim 8, wherein said triangular control orifice is disposed in the wall of said shaft and said control slot is defined by the gap between two coaxial bushings surrounding said shaft.

10. A fuel injection system as defined by claim 8, further comprising a spacer ring disposed between adjacent faces of said bushings to thereby determine the effective size of said control slot.

11. A fuel injection system as defined by claim 8, further comprising a coaxially and fixedly surrounding sleeve on said shaft, said triangular opening being provided in said sleeve and there being provided two coaxial bushings surrounding said sleeve, and said control slot being defined by the gap between said two bushings.

12. A fuel injection system as defined by claim 11, wherein said sleeve is composed of two partial sleeves adjacent edges of which are oblique with respect to the long axis of said shaft and wherein the relative slope of said oblique edges defines said triangular control opening.

13. A fuel injection system as defined by claim 8, wherein said sleeve has a radial bore communicating with said internal bore in said shaft whereby fuel may be transported through said shaft to the points of delivery in said induction tube.

14. A fuel injection system as defined by claim 8, including means for adding air to the metered out fuel quantity prior to delivery to the induction tube.

15. A fuel injection system as defined by claim 1, including means for changing the fuel pressure upstream of said fuel metering means in dependence on operational engine variables.

16. A fuel injection system as defined by claim 1, wherein said restoring force is provided by pressurized fuel and including means for providing said pressurized fuel, said bearings for said shaft including a space into which said shaft extends and in which a restoring force may be exerted on it.

17. A fuel injection system as defined by claim 16, including means for changing the pressure of said fluid exerting said restoring force as a function of engine variables.

18. A fuel injection system as defined by claim 17, further comprising a check valve disposed between said space and said internal bore of said shaft, said check valve being located downstream of said fuel metering means, whereby when said baffle plate undergoes sudden opening motions said check valve temporarily permits communication between a source of fuel and said internal bore in said shaft thereby producing a temporary enrichment of the fuel-air mixture provided to the engine.

19. A fuel injection system as defined by claim 1, further comprising two mutually rotatable rings disposed in said induction tube coaxially with respect to said shaft for partial and variable obturation of the free passage of said induction tube, said rings being disposed downstream of said baffle plate.

* * * * *